United States Patent [19]

Cameron

[11] 4,202,504

[45] May 13, 1980

[54] TWO-PIECE HAMMERS FOR HAMMER MILLS

[75] Inventor: Wallace C. Cameron, San Pedro, Calif.

[73] Assignee: Copper Alloys Corp., Beverly Hills, Calif.

[21] Appl. No.: 924,500

[22] Filed: Jul. 14, 1978

[51] Int. Cl.[2] ..... B02C 13/20

[52] U.S. Cl. ..... 241/194; 241/197

[58] Field of Search ..... 241/189 R, 189 A, 191, 241/194, 197, 294, 300

[56] References Cited

U.S. PATENT DOCUMENTS

| | | | |
|---|---|---|---|
| 1,456,987 | 5/1923 | Lucas | 241/197 |
| 1,717,759 | 6/1929 | Briggs | 241/197 |
| 2,531,597 | 11/1950 | Anderson | 241/197 |
| 2,534,302 | 12/1950 | Sennholtz | 241/197 |
| 3,207,448 | 9/1965 | Miller | 241/197 |
| 3,236,463 | 2/1966 | Ratkowski | 241/197 |
| 3,367,585 | 2/1968 | Ratkowski | 241/197 |
| 3,510,076 | 5/1970 | Perdue | 241/197 |
| 3,727,848 | 4/1973 | Francis | 241/197 X |
| 4,000,859 | 1/1977 | Whitney | 241/197 X |

*Primary Examiner*—Mark Rosenbaum

*Attorney, Agent, or Firm*—I. Morley Drucker

[57] ABSTRACT

A two-piece hammer for a rotary hammer mill having a separate hammer shank and a separate replaceable hammer tip. The shank and the tip have interlocking portions so that when the two parts are assembled and secured by a transverse pin they form a unitary hammer body that may be mounted on a rotor assembly in a hammer mill used for crushing or shredding materials.

21 Claims, 7 Drawing Figures

Fig. 4
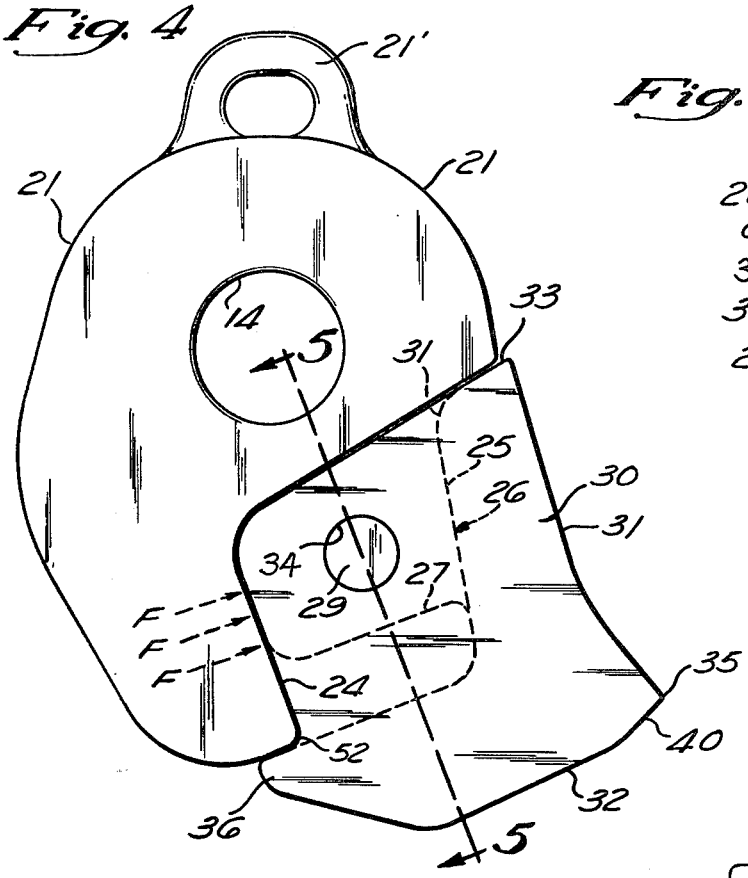
Fig. 5
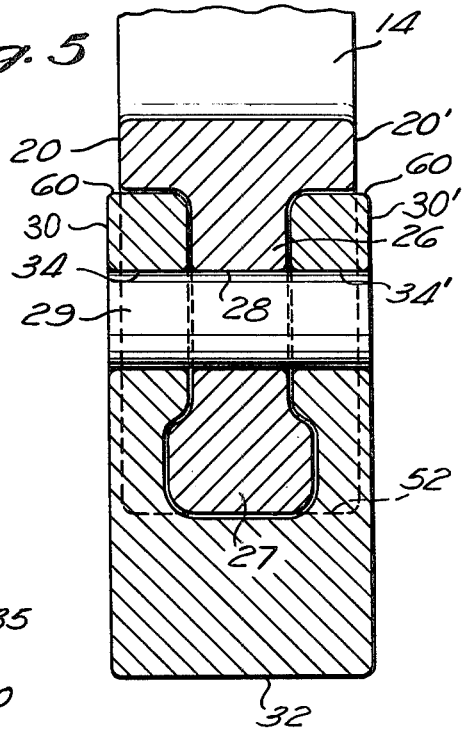
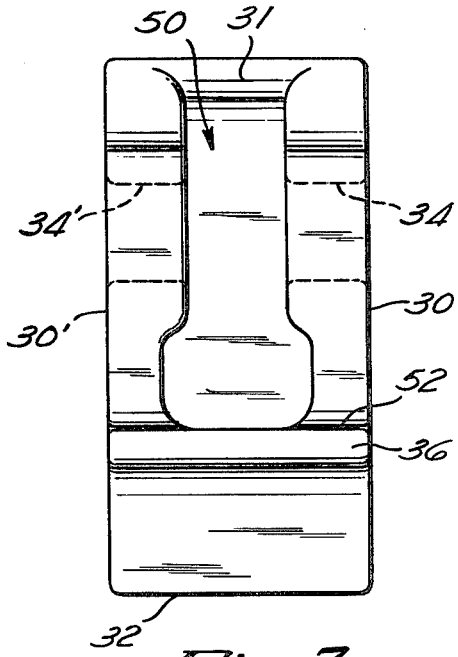
Fig. 7
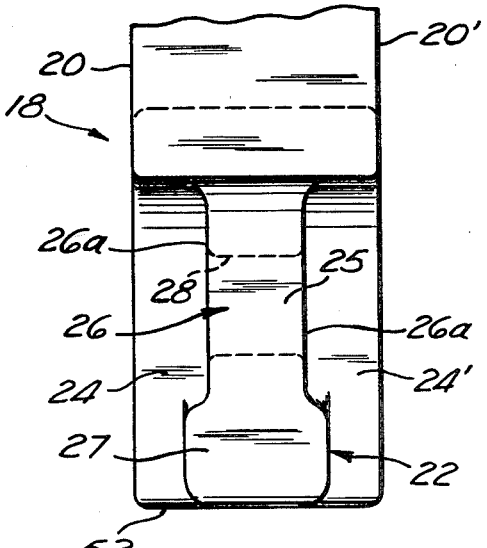
Fig. 6

TWO-PIECE HAMMERS FOR HAMMER MILLS

BACKGROUND OF THE INVENTION

There is a continuing need for improvements in two-piece hammers for use in hammer mills, shredders and rotary crushers. Such two-piece hammers have a separate hammer shank and a separate replaceable hammer tip. Although such two-piece hammer devices have been known and used widely for a long time, a major drawback in such devices still exists. The major problem resides in the fact that particles of ground material tend to penetrate the joint between the hammer parts and become compacted therein, making it very difficult to separate a worn hammer tip from its shank. This so-called "liming up" of the hammer parts is compounded when the interlocking portions of the hammer pieces include complexly arcuate surfaces such as keys, hinges and forked arms. Abrasion of sharp edges between the hammer parts is an inherent source of ground material which tends to bond the parts under the high operating pressures to which the hammer is normally subjected.

Some designs appear to have encouraged internal abrasion of the hammer parts by purposely allowing room between the hammer tip and the hammer shank for the two to wedge together under operating stress. Past attempts to solve these difficulties have not yielded fully satisfactory results.

SUMMARY OF THE INVENTION

The invention is directed to an improved two-piece hammer for use in a rotary hammer mill. The term "rotary hammer mill", as used herein, is meant to include reduction mills, mills operating on a rotary shear principle, shredders, fragmentizers, and pulverizers for the purpose of reduction of various materials, such as metals, ores and slags, and solid wastes. The hammer has a reusable hammer shank and a separate replaceable hammer tip, each having portions which interlock to form a unitary hammer body. One end of the hammer shank is adapted to pivot about a rotary shaft member and the opposite end has a flared tongue which interfits with a complementary groove in the hammer tip, the assembly being further secured by means of a retaining pin passing through aligned bores in each of the two pieces. The hammer tip is dimensionally larger, or oversize with respect to the shank at the line of juncture between the two hammer parts. The resulting joint line is effectively shielded from the zone of fall out of foreign material during impace of the striking face of the hammer tip with the material being shredded. Protection is thus afforded against intrusion of foreign materials into the joint line which in the past has led to the aforementioned "liming up" or locking together of the hammer parts (and thus defeating the purpose of a replaceable hammer tip). Further protection against intrusion of materials into the joint line is given by lip portions extending from the hammer tip over various portions of the joint line, which prevents shreds of material from wedging themselves between the hammer shank and the hammer tip.

A further and important improvement is the extensive use of planar surfaces in the interlocking portions of the hammer parts, which surfaces are disposed so that a greater part of the impact force on the striking surface of the hammer face acts along a vector approximately normal to a relatively large surface area. This is distinguishable from prior designs in which the forces act upon arcuate surfaces or at acute angles to the interlocking surfaces, thereby increasing the possibility of distortion and wedging together of the hammer pieces.

Other objects and advantages of the invention will be seen in the details of construction and operation set forth in this specification.

BRIEF DESCRIPTION OF THE DRAWINGS

FIG. 4 is a side view of a single assembled hammer of this invention with the interlocking and mating internal surfaces shown in broken lines;

FIG. 5 is a cross-sectional view taken along line 5—5 of FIG. 4;

FIG. 6 is a top view of the hammer shank 9 as viewed along the line 6—6 of FIG. 3; and FIG. 7 is a bottom view of the hammer tip 10 as viewed along the line 7—7 of FIG. 3.

DESCRIPTION OF THE PREFERRED EMBODIMENT

Figure 1:
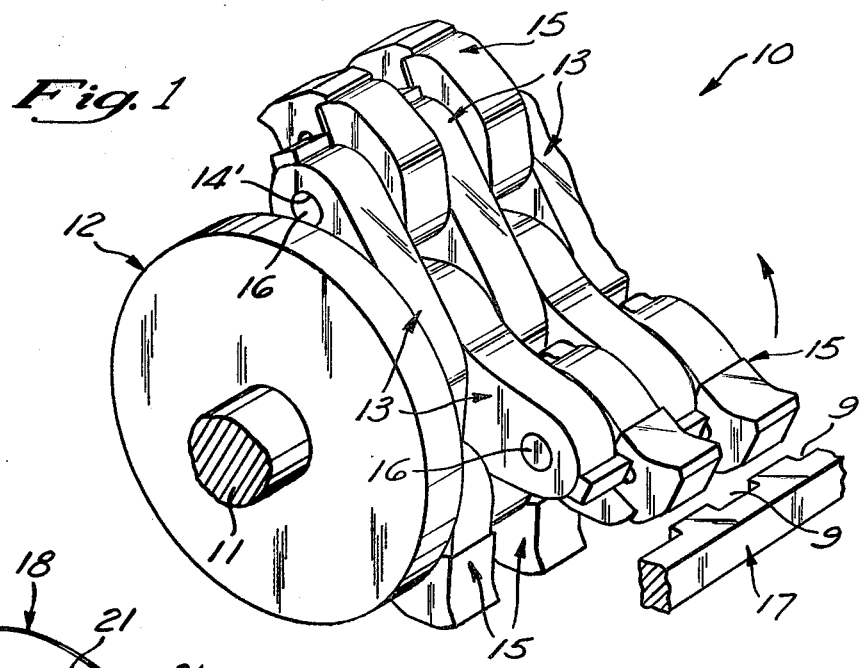
FIG. 1 is a fragmentary perspective view of a hammer rotating assembly employing the hammer of the present invention.

In FIG. 1 is shown a partial illustration of a rotatable hammer assembly 10, which is mounted on a main rotor shaft 11 and secured by conventional means (not shown) between end disks 12, only one of which is shown in FIG. 1.

The hammer assembly 10 includes a plurality of spaced rotor arms 13, each arm being rotatably mounted onto main rotor shaft 11. Each rotor arm 13 is provided at each end thereof, with a bore 14' for the attachment thereto of hammers 15. Hammers 15 are pivotally mounted between adjacent rotor arms 13 by means of a hammer bearing shaft 16 passing through bores 14' in the rotor arms and the aligned bore 14 of hammer shank 18, the bore 14 being shown in FIG. 2. Material sufficiently broken up by the actions of rotating hammers 15 coacting with the fixed cutting surface 17 of the hammer assembly 10 drops through openings 9 provided for that purpose.

Referring now to FIGS. 2–7, the hammer 15 is comprised of two elements, the reusable hammer shank 18 and the replaceable hammer tip 19 which interlock to form a unitary hammer body.

Figure 2:
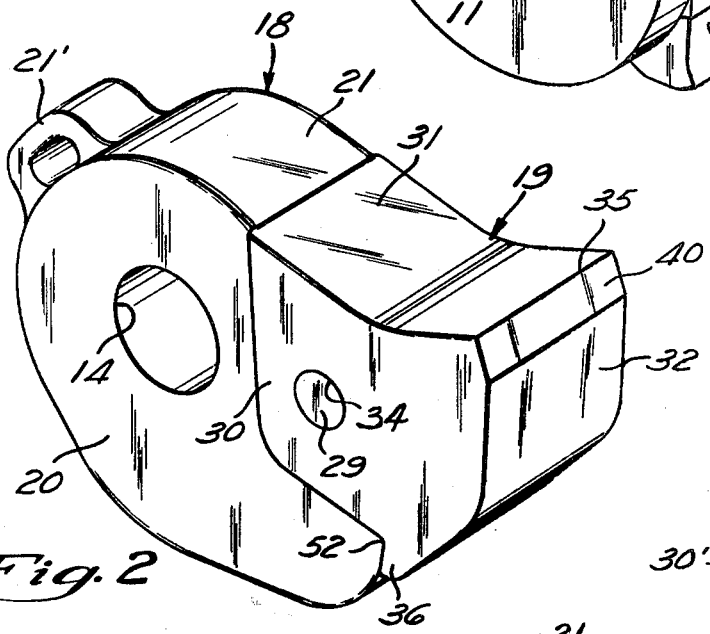
FIG. 2 is a perspective view of a single assembled hammer.
Figure 3:
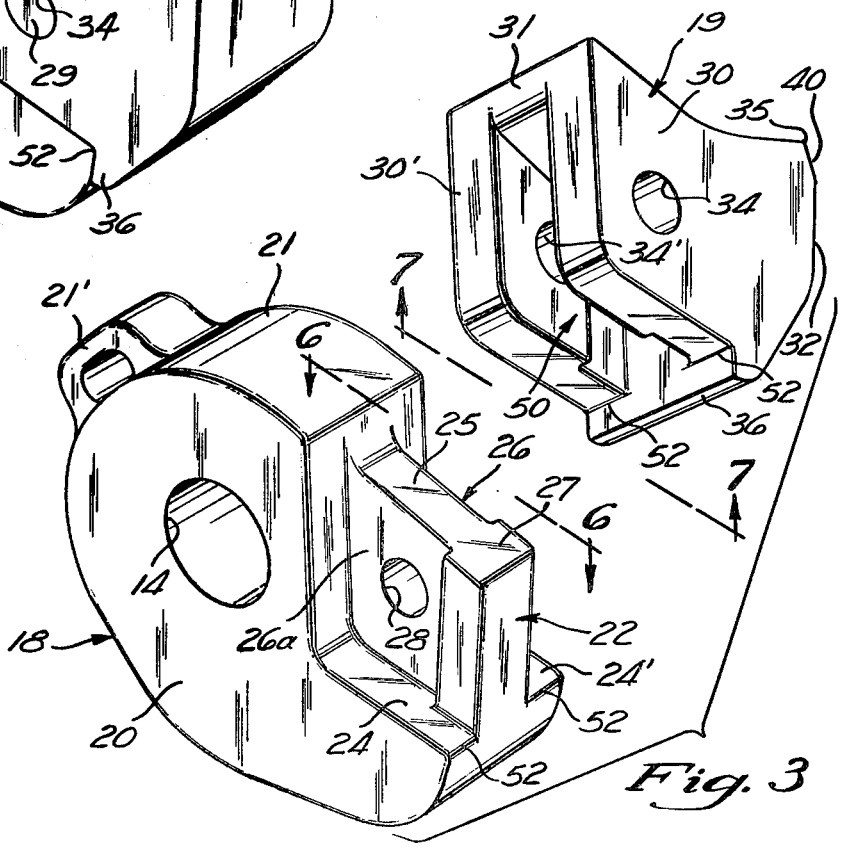
FIG. 3 is an exploded perspective view showing the individual hammer elements.

The hammer shank 18 is a solid body comprising parallel side surfaces 20 and 20', a smooth, generally arcuate surface 21 which curves around the top, rear and bottom of the hammer shank 18, and a hammer tip engaging portion or tongue portion generally numbered 22. A handle portion 21' is integrally formed on the rear part of surface 21 to facilitate assembly, removal, and general handling of the hammer 15. The tongue portion 22 comprises a narrow bridging portion 26 terminating in a flared outer portion 27. The side surfaces **26*a* of bridging portion 26 are planar and parallel to each other. The flared portion 27 is generally rectangular in top plan view. The narrow bridging portion 26 is slightly wedge shaped, the side walls 26*a* being wider at their upper ends than at the lower ends. The tongue 22 is provided with a pin receiving bore 28 adapted to receive hammer tip retaining pin 29 which is shown in FIGS. 2 and 4 positioned in the assembled hammer. On either side of tongue 22 are co-planar impact receiving surfaces 24 and 24' which are substantially parallel with a third impact receiving surface 25 comprising the upper surface of tongue 22**.

The hammer tip 19 comprises two generally parallel side walls 30 and 30' joined along their upper edges by a hammer striking face portion 31 and further joined along the outer side edge by a wiping face portion 32, as best shown in FIGS. 2 through 4 and 7. The side walls 30 and 30' together with wiping face portion 32, define a groove 50 which slidably interfits with tongue portion 22.

At the intersection of the hammer striking face portion 31 with the wiping portion 32, a leading shearing surface 40 and cutting edge 35 is provided, as shown in FIGS. 2 and 4.

Pin receiving bores 34 and 34' of hammer tip 19 in the side walls 30, 30' are aligned with each other and align with the pin receiving bore 28 of the hammer shank 18 when the hammer tip 19 is mounted thereon, and serve to receive tip retaining pin 29, as shown in FIGS. 2 and 4 as part of the assembled hammer.

It will be appreciated by those skilled in the art that the hammer tip retaining pin 29 only counteracts the force of gravity on the hammer tip 19 and serves to retain the same on the shank when the hammer recoils upon striking an object which does not yield under the impact. During forward motion the full force of the hammer blows is absorbed by the hammer tip 19 and transferred to the shank 18 through the interlocking surfaces so that no stress is applied to pin 29. In addition, the centrifugal force generated upon rotation of the hammer tip is taken up by the flaring portion 27 of the tongue 22.

The wiping face portion 32 is provided, at its lowermost area, with a lip 36 which overlies the line of juncture 52 established between the hammer shank 18 and the hammer tip 19, to minimize entry of fragments and particles created in the shredding or shearing process, and minimizing the wedging of such particles between the two pieces. Such accumulations between component parts of rotary hammer assemblies have created a severe problem in the past because under the heavy pressures inflicted on the various parts, any material introduced between such parts tends to cement the components together. This process is known in the industry as "liming up" and it makes disassembly of the hammer very difficult and sometimes impossible, defeating the purpose of a replaceable hammer tip.

Another feature of the present invention directed to this problem is that the hammer tip is wider than the shank, as can be seen in FIG. 5 at 60 and is also higher than the shank when seated thereon as in FIG. 4 at 33. These important features prevent wedging of material in the joints between the two pieces to a higher degree than previous hammers by shielding said joint from the zone of fallout of foreign material during impact of the striking face of the hammer tip with the material being shredded or sheared. The oversized hammer tip (with respect to the shank) also provides useful exposed edges 60 extending along the entire joint line between shank and tip where force may be applied to the tip for the purpose of facilitating separation of the tip from the shank. In particular, force is applied along the direction of arrows F, F (see FIG. 4) to a portion of the exposed edge 60, to facilitate disengagement. The separation of the tip portion from the hammer shank is further facilitated by the use of the increasing taper provided by the wedge shape of the narrow briding portion 26.

Previous hammer designs have relied on complexly curved interlocking surfaces such as hinges, keys and forked arms to avoid "liming up" or locking together of the shank and hammer tip. The present invention employs a simpler design wherein the locking surfaces of shank and tip are largely planar, permitting relatively easy separation of tip from shank, especially in view of the fact that a minimum entry of fragments is provided for.

It is further to be noted that the plane surfaces defining the interlocking portions are so oriented that a greater part of the impact force on the hammer face is transmitted along a vector which is generally perpendicular (i.e., not more than 30° from perpendicular) to the substantially parallel impact received surfaces 24, 24', and 25 of the shank 18. The combined surface area of impact receiving surfaces 24, 24' and 25 is equal to at least fifty percent (50%) of the surface area of the hammer striking face 31. As a result, the forces are spread over a relatively large surface as compared to some prior art devices where stresses are concentrated on relatively smaller areas, due to the complexly arcuate structures used in some designs, or, in others, due to the orientation of the interlocking surfaces at acute angles with respect to the incident forces.

Sharp edges in the interlocking surfaces tend to abrade under operating conditions and are an inherent source of particles which contribute to liming up. Further, sharply defined lines and edges add to the cost and difficulty of manufacturing the hammers. The present invention does not require sharp delineation of the interlocking parts; the design relies almost completely on the interaction between plane surfaces having soft or rounded edges and consequently, it can be manufactured by casting methods without the necessity to machine the parts to ensure a proper fit.

While the foregoing description of the preferred embodiment of the invention has been set forth for purposes of explanation, it will be understood that many variations and changes may be made without departing from the spirit and scope of the invention.

I claim:

1. A two piece hammer for use in a rotary hammer mill assembly comprising:

(a) a reusable hammer shank element having a portion adapted to receive a hammer tip element and (b) a separate replaceable hammer tip element having striking face portion, said hammer shank element and hammer tip element each having an interlocking portion wherein the interlocking portion of said hammer shank element comprises a plurality of substantially parallel planar impact receiving surfaces having a combined surface area greater than fifty per cent (50%) of the surface area of said hammer striking face portion, said hammer shank element being further provided with a flared portion, said interlocking portion of said hammer tip element comprising a groove portion having complemental surfaces to those of said flared portion for slidable interlocking of said flared and grooved portions along lines of juncture substantially perpendicular to the axis of rotation of said rotary hammer mill whereby to resist the thrust of centrifugal forces imposed by the rotation of said rotary hammer mill.

2. The hammer of claim 1 wherein said hammer tip element is oversized relative to said hammer shank element at the line of juncture between said hammer tip element and said hammer shank element.

3. The hammer of claim 2 wherein the width of the hammer tip exceeds the width of the hammer shank in the vicinity of the line of juncture of said hammer tip and said hammer shank, which excess width provides the hammer tip element of said two piece hammer with exposed edges, which exposed edges are adapted to be engaged by separate force means for separation of said hammer tip element from said hammer shank element.

4. The hammer of claim 1 wherein the hammer tip element has a lip portion extending over and covering at least a part of the line of juncture of said hammer tip element with said hammer shank element.

5. A two piece hammer for use in a rotary hammer mill assembly comprising:

(a) a reusable hammer shank element having a portion adapted to receive a hammer tip element and (b) a separate replaceable hammer tip element having a hammer striking face portion, said hammer shank element and hammer tip element each having an interlocking portion, each of which interlocking portions comprise impact receiving surfaces which are substantially planar and which are generally perpendicular to the incident forces acting upon said hammer striking face portion, the said impact receiving surfaces of the hammer shank element is equal to at least fifty percent (50%) of the surface area of said hammer striking face portion, said hammer shank element being further provided with a flared portion, said interlocking portion of said hammer tip element comprising a groove portion having complemental surfaces to those of said flared portion for slidable interlocking of said flared and groove portions along lines of juncture substantially perpendicular to the axis of rotation of said rotary hammer mill whereby to resist the thrust of centrifugal forces imposed by the rotation of said rotary hammer mill and pin receiving bores provided in each of said hammer shank and hammer tip element which are aligned along an axis parallel to the axis of rotation of said rotary hammer mill when said flared and groove portions are seated in interlocking position.

6. The hammer of claim 5 wherein said hammer tip element is oversized relative to said hammer shank element at the line of juncture defined upon the interlocking of said hammer tip element and said hammer shank element.

7. The hammer of claim 6 wherein the width of the hammer tip exceeds the width of the hammer shank at said line of juncture of said interlocked hammer tip and hammer shank elements, which excess width provides the hammer tip element of said two piece hammer with exposed edges, which exposed edges are adapted to be engaged by separate force means for separation of said hammer tip element from said hammer shank element.

8. The hammer of claim 5 wherein the hammer tip element has a lip portion extending over and covering at least a part of the line of juncture defined by the interlocking of said hammer tip element with said hammer shank element.

9. A two piece hammer for use in a rotary hammer mill assembly comprising:

(a) a reusable hammer shank element having a portion adapted to receive a hammer tip element, and (b) a separate replaceable hammer tip element having a hammer striking face portion, said hammer shank element and hammer tip element each having an interlocking portion, the interlocking portion of the hammer shank element comprising a tongue portion having a relatively narrow bridging portion terminating in an outer flared portion, said bridging portion having a first pin receiving bore, and the interlocking portion of the hammer tip element comprising a groove portion having complemental surfaces to those of the tongue portion for interlocking of said tongue and groove portions to resist the thrust of centrifugal forces imposed by the rotation of said rotary hammer mill, and a second and third pin receiving hammer mill, and a second and third pin receiving bores provided in said hammer tip element, said second and third pin receiving bores being alignable with said first pin receiving bore when said tongue and groove portions are seated in interlocking position.

10. The hammer of claim 9 wherein the tongue portion has an inner edge and a lower edge, said inner and lower edges merging with the body of the hammer shank element.

11. The hammer of claim 9 wherein the flared portion of said tongue portion is located at the outer edge of said tongue and is of generally rectangular shape in top plan view and merges gradually with the bridging portion of said tongue portion.

12. The hammer of claim 9 wherein said first, second and third pin receiving bores lie substantially at right angles to side walls defining said tongue portion.

13. The hammer of claim 9 wherein said interlocking portions define a line of juncture upon assembly of said hammer shank and said hammer tip and wherein the width of said hammer tip element is of larger dimension at said line of juncture than the width of said hammer shank element at said line of juncture.

14. The hammer of claim 9 wherein the hammer tip element has a lip portion extending over and covering at least a part of the line of juncture defined upon interlocking of said hammer tip element with said hammer shank element.

15. The hammer of claim 9 wherein the hammer striking face of the hammer tip element is positioned forward of the leading surface of the hammer shank element during rotation of said rotary hammer mill.

16. The hammer of claim 9 wherein said narrow bridging portion of said tongue portion is wedge shaped in side elevation.

17. The hammer of Claim 16 wherein said wedge-shaped bridging portion is of increasing taper in the direction of disengagement of said hammer tip element from said hammer shank element.

18. The hammer of claim 9 wherein said relatively narrow bridging portion of said hammer shank element is defined, in part, by substantially parallel side walls.

19. The hammer of claim 9 wherein said relatively narrow bridging portion of said hammer shank element is defined, in part, by substantially parallel, planar, side walls.

20. The hammer of claim 9 wherein said relatively narrow bridging portion of said hammer shank element is defined, in part, by substantially parallel side walls and said outer flared portion is defined, in part, by substantially parallel side walls.

21. The hammer of claim 9 wherein said relatively narrow bridging portion of said hammer shank element is defined, in part, by substantially parallel side walls, said outer flared portion of said hammer shank element is defined, in part, by substantially parallel side walls, said groove portion of said hammer tip element having complemental surfaces to those of said bridging portion and outer flared portion of said tongue portion, said first, second and third pin receiving bores being substantially normal to said side walls defining said bridging portion, and said outer flared portion interlocking the hammer tip element against said thrust of centrifugal forces imposed by the rotation of said rotary hammer mill.

* * * * *

UNITED STATES PATENT OFFICE

CERTIFICATE OF CORRECTION

PATENT NO. : 4,202,504

DATED : May 13, 1980

INVENTOR(S) : WALLACE C. CAMERON

It is certified that error appears in the above-identified patent and that said Letters Patent are hereby corrected as shown below:

Column 6, lines 15 and 16, after "mill," delete "and a second and third pin receiving hammer mill,"

Signed and Sealed this

*Thirtieth* Day of *September 198*

[SEAL]

*Attest:*

SIDNEY A. DIAMOND

*Attesting Officer*

*Commissioner of Patents and Trademar*